US005443643A

United States Patent [19]

Cardini et al.

[11] Patent Number: 5,443,643

[45] Date of Patent: Aug. 22, 1995

[54] HEATLESS RESIN COATING SYSTEM

[75] Inventors: Giuseppe Cardini; Alessandro Faraoni, both of Florence, Italy

[73] Assignee: Axis USA, Inc., Tampa, Fla.

[21] Appl. No.: 50,832

[22] Filed: Apr. 21, 1993

[51] Int. Cl.[6] ..... B05C 5/00

[52] U.S. Cl. ..... 118/712; 118/66; 118/669; 118/678; 118/681; 118/687; 118/502; 118/503

[58] Field of Search ..... 118/64, 66, 712, 669, 118/678, 681, 687, 502, 503; 222/135, 145, 108; 269/287, 288, 317

[56] References Cited

U.S. PATENT DOCUMENTS

| | | | |
|---|---|---|---|
| 2,695,595 | 11/1954 | Hagerman | 118/502 |
| 2,781,020 | 2/1957 | Scott | 118/681 |
| 2,962,193 | 11/1960 | Totten | 222/145 |
| 2,977,924 | 4/1961 | Bender et al. | 118/669 |
| 3,413,955 | 12/1968 | Patti | 118/503 |
| 3,540,626 | 11/1970 | Eberle | 222/135 |
| 3,844,818 | 10/1974 | Morrison | 118/503 |
| 4,009,301 | 2/1977 | Heckman et al. | 118/66 |
| 4,357,900 | 11/1982 | Buschor | 118/681 |
| 4,695,482 | 9/1987 | Weiswurm | 118/681 |
| 4,846,373 | 7/1989 | Penn et al. | 222/145 |
| 4,908,153 | 3/1990 | Kossmann et al. | 118/503 |
| 4,911,099 | 3/1990 | Ohmura et al. | 118/64 |
| 5,060,594 | 10/1991 | Tomioka et al. | 118/64 |
| 5,078,083 | 1/1992 | DiMaio et al. | 118/503 |
| 5,271,521 | 12/1993 | Noss et al. | 222/135 |

FOREIGN PATENT DOCUMENTS

| | | |
|---|---|---|
| 0007207 | 1/1980 | European Pat. Off. . |
| 0142583 | 5/1985 | European Pat. Off. . |
| 0501264 | 9/1992 | European Pat. Off. . |
| 1494745 | 8/1967 | France . |
| 2473361 | 7/1981 | France . |
| 3732113 | 10/1988 | Germany . |
| 3720525 | 12/1988 | Germany . |
| 381608 | 8/1964 | Switzerland . |

*Primary Examiner*—W. Gary Jones
*Assistant Examiner*—Laura E. Edwards
*Attorney, Agent, or Firm*—Fish & Neave; Jeffrey H. Ingerman

[57] ABSTRACT

A resin coating system having an endless conveyor for passing components to be coated with resin successively through a preheating station, a resin coating station, and a gelification station. Coated components are exchanged with uncoated components at a transfer station along the conveyor between the gelification station and the preheating station. If an uncoated component is not ready to be transferred into the coating system or later processing machines are not ready to receive a coated component, then exchange of coated and uncoated components does not take place at the transfer station, and the coated component reapproaches the preheating and coating stations. A system and method for allowing coating of uncoated components to be completed while coated components passing through the coating station are prevented from being recoated is also provided.

31 Claims, 13 Drawing Sheets 222
214
200
216
212
210
202
201
204
206

HEATLESS RESIN COATING SYSTEM

BACKGROUND OF THE INVENTION

The present invention relates to a system and method for coating the coils of electric motor or electric generator components ("components") with a resin which preferably does not require heating after application. More particularly, the present invention relates to a system, and a related method, for coating components by continuously conveying the components through successive stations so that a plurality of components may be incrementally serviced until each component is completely and properly coated with resin. Additionally, the system and related method are capable of selectively applying resin to components so that a coated component adjacent to an uncoated component will not be recoated.

Resins are often used to coat wire coils (such as in the present invention). Heatless polyester resins are capable of bonding strengths equivalent to those of traditional resins but cure by means of an exothermic chemical reaction which takes place at room temperature. Curing in this way accordingly obviates the heating and cooling stages normally required to cure traditional resins.

Elimination of heating and cooling stages provides various advantages including: energy savings, savings in coating system costs, and savings in manufacturing spacing which needs to be dedicated to the heating and cooling equipment required by traditional resin application systems. The use of heatless resins also substantially eliminates the airborne emissions associated with high temperature curing of traditional resins.

A typical cycle for coating armatures with heatless resins requires heating the wire coils to a moderate temperature within the range of 45° C. to 60° C., exposing the coils to a series of resin dispensers for applying progressive amounts of resin to the coils, allowing the resin to harden, and eventually aging the resin.

Preheating of the components is carried out so that the resin reaches an ideal viscosity on the component to penetrate and fill the spacings between the coil wires. The preheating stage also reduces the time required for the resin to harden. Accordingly, a precise choice of the temperature in this stage must be made, taking into account such factors as: the type of armature to be coated, the resin being used for coating, and the production rates required by the coating operation.

The preheated components are passed through a resin dispensing/coating station in which the components are coated with resin. Preferably, the components to be coated are rotated during application of the resin so that a uniform coat may be formed.

The resin coating station typically includes a plurality of resin dispensers, such as manufactured by Liquid Control Corp. of North Canton, Ohio. Each resin dispenser typically comprises a mixer tube in which resin and a catalyst are fed and mixed. The resin, such as manufactured by The P.D. George Co., St. Louis, Mo., and the catalyst are stored in separate containers and are fed by piston pumps through supply tubes to a distributor. Until they reach the outlet of the distributor, the resin and catalyst are kept apart. The resin and catalysts are only joined as they enter the mixer tube, which has a helical path which causes a highly efficient mixing operation to occur when the resin and catalyst flow together. By activating the piston pumps at predetermined and programmable time intervals, and by regulating the stroke of their pistons, a required ratio of resin and catalyst can be fed to the mixer tube to form the desired resin composite. Mixing the catalyst with the resin causes the exothermic reaction that hardens the resin to start even at room temperature.

Once the coils have been coated with resin, they can be exposed to room temperature for gelification. Gelification is a term usually used to indicate a stage in which the resin hardens to a point at which there is no further risk of dislocation caused by manipulation of the coated coil. During gelification, coated components need to be rotated to avoid accumulation in certain areas due to the force of gravity so that the resin will be uniformly distributed within and over the coils.

Once gelification has been completed, the resin undergoes a process which is typically called aging. During this process, an internal transformation of the resin, which occurs for many hours at room temperature, increases the bonding strength to that required to hold the wires together. Normally, there is no need to postpone manipulating or processing steps after coating in order for the aging stage to be complete. On the contrary, after gelification, the components can be manipulated and processed without incurring any significant risk of dislocating the resin.

In a properly coated component, the spaces between the coil wires should be substantially completely filled with resin and all air gaps between the coil wires should be substantially completely eliminated. The resin should also have a sufficient bonding strength to hold the coil wires together, which is the principle purpose of this technology.

A system for applying heatless resins should smoothly transport the components from one stage to another without much delay between stages, so that the coating process may be achieved quickly and efficiently, without allowing a preheated component to cool before reaching resin dispensers or allowing resin to harden unevenly during resin application or transfer to the gelification stage. If any delays occur at any point in the coating process, components in the midst of treatment may be rendered unusable.

Known methods for applying heatless resins present several potential disadvantages. The reaction of the resin and catalyst during mixing needs to be carefully time-controlled because after the catalyst has been added, the exothermic reaction that causes the resin to harden occurs quickly. This means that if the catalyzed resin remains in the mixer tube of the dispenser for more than a certain well-defined amount of time, the mixer tube may become blocked by the hardened resin. The blocked tube would then have to either be flushed with a volatile solvent or discarded.

Additionally, if the application of resin to the coils being coated is interrupted for more than a certain amount of time, then partial hardening may occur before the required amount of resin has been deposited on the coils. In such a case, it may be difficult to complete coating of these components by adding further resin. The resulting components will be defective and are usually a total loss without the possibility of recovery. Such a disadvantage even occurs when using traditional resins.

Finally, if a coated component cannot be removed from the coating system, and therefore reapproaches the resin dispensers for coating, any further application of resin will typically render the recoated component useless. Such a disadvantage also occurs when using traditional resins.

It therefore would be desirable to provide a system and method for applying heatless resin incrementally, successively, and continuously. The system should efficiently simultaneously process a plurality components so that an uncoated component entering the system leaves the system completely and properly coated and ready to be operated on in the next station.

It would also be desirable to provide a system and method for resin-coating which allows for complete processing of components already in the system when supply of new components is interrupted.

It would further be desirable to provide a system and method for resin-coating which selectively applies resin to uncoated components and not to coated components also in the coating system, while not causing blockage of the resin dispensers.

SUMMARY OF THE INVENTION

It is therefore an object of this invention to provide a system and associated method for applying heatless resin which incrementally, successively, and continuously processes components to produce a properly coated component.

It is a related object of this invention to provide a system and method for applying heatless resin which is compact, is relatively inexpensive, and can simultaneously process numerous components.

It is another object of this invention to provide a system and method for applying resin to components which allows for complete processing of components already in the system when supply of new components is interrupted.

It is yet another object of this invention to provide a system and method for applying resin to selected components in a resin coating station while other components in the resin coating station are not being coated.

It is a further object of this invention to provide a system and method for applying resin which stops the flow of resin onto a component without causing blockage of the mixer tube of the resin dispenser.

These and other objects of the invention are accomplished in accordance with the principles of this invention by providing a system having an endless conveyor which transports components to be coated through all of the stations required for proper coating of a component with heatless resin. Such stations include a preheating station, a resin coating station, and a gelification station. If the supply of new components is interrupted, the system preferably continues to coat all uncoated components. Means for preventing resin from flowing on coated components which may pass through the resin coating station with components which still need to be coated are also provided. Such means for preventing resin flow do not interfere with later resumption of resin flow.

BRIEF DESCRIPTION OF THE DRAWINGS

The above and other objects and advantages of the invention, its nature, and various advantages will be apparent from the following detailed description of the preferred embodiments, taken in conjunction with the accompanying drawings, in which like reference characters represent like elements throughout, and in which.

DETAILED DESCRIPTION OF THE INVENTION

Figure 1:
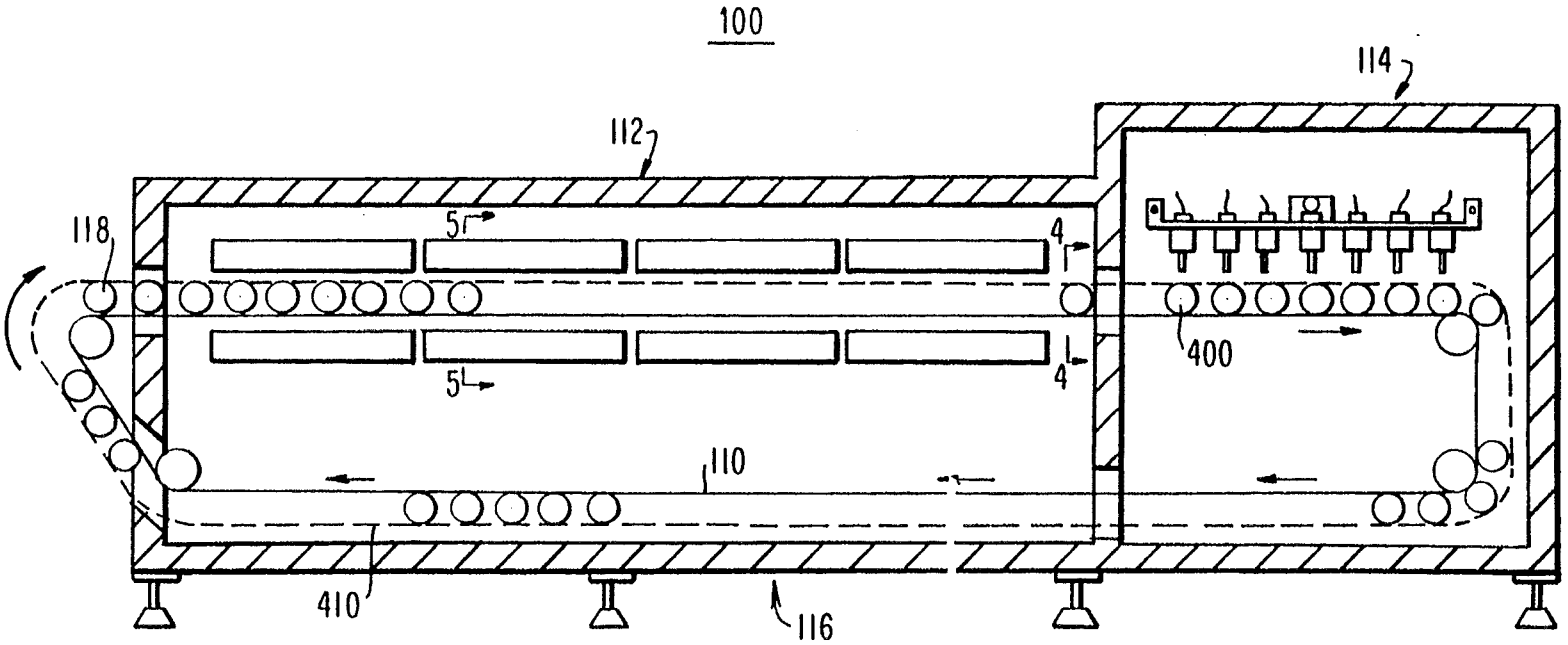
FIG. 1 is a schematic elevational view, partly in section, view of a heatless resin coating system in accordance with the principles of this invention.
Figure 4:
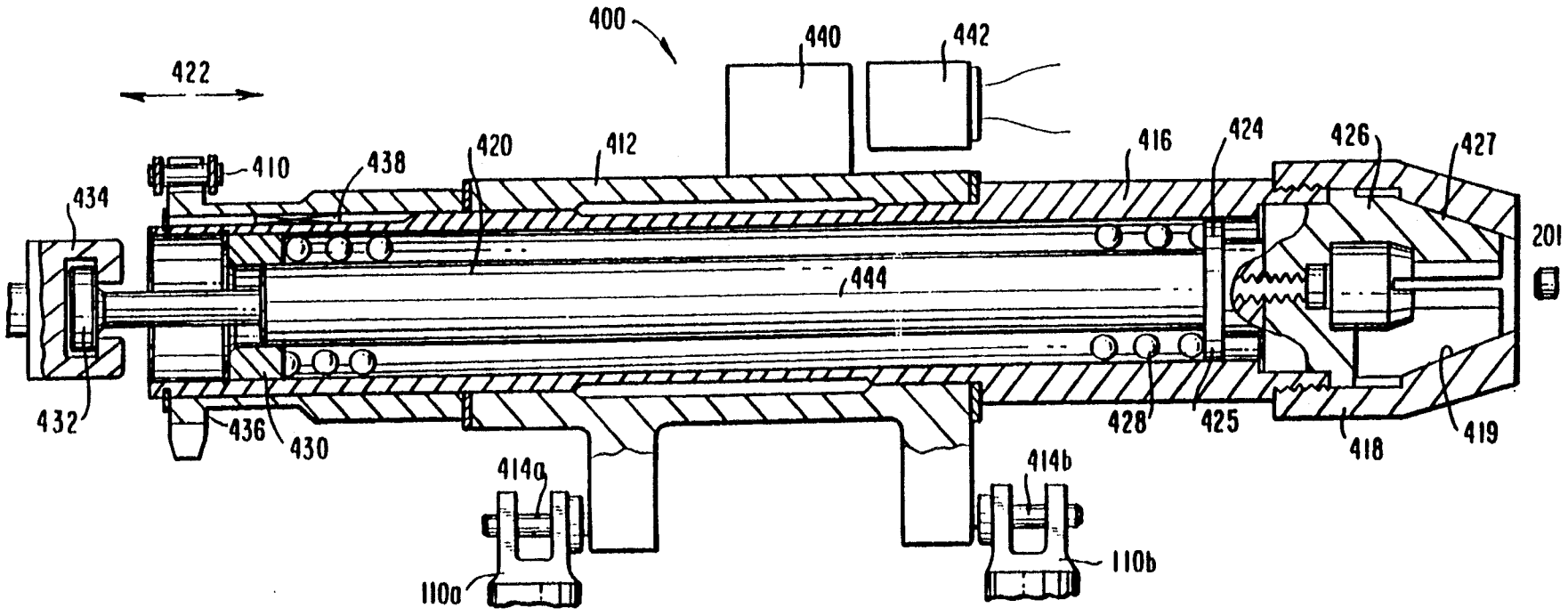
FIG. 4 is a vertical cross-sectional view of a holding device in accordance with the principles of this invention, taken along line 4—4 of FIG. 1.
Figure 5:
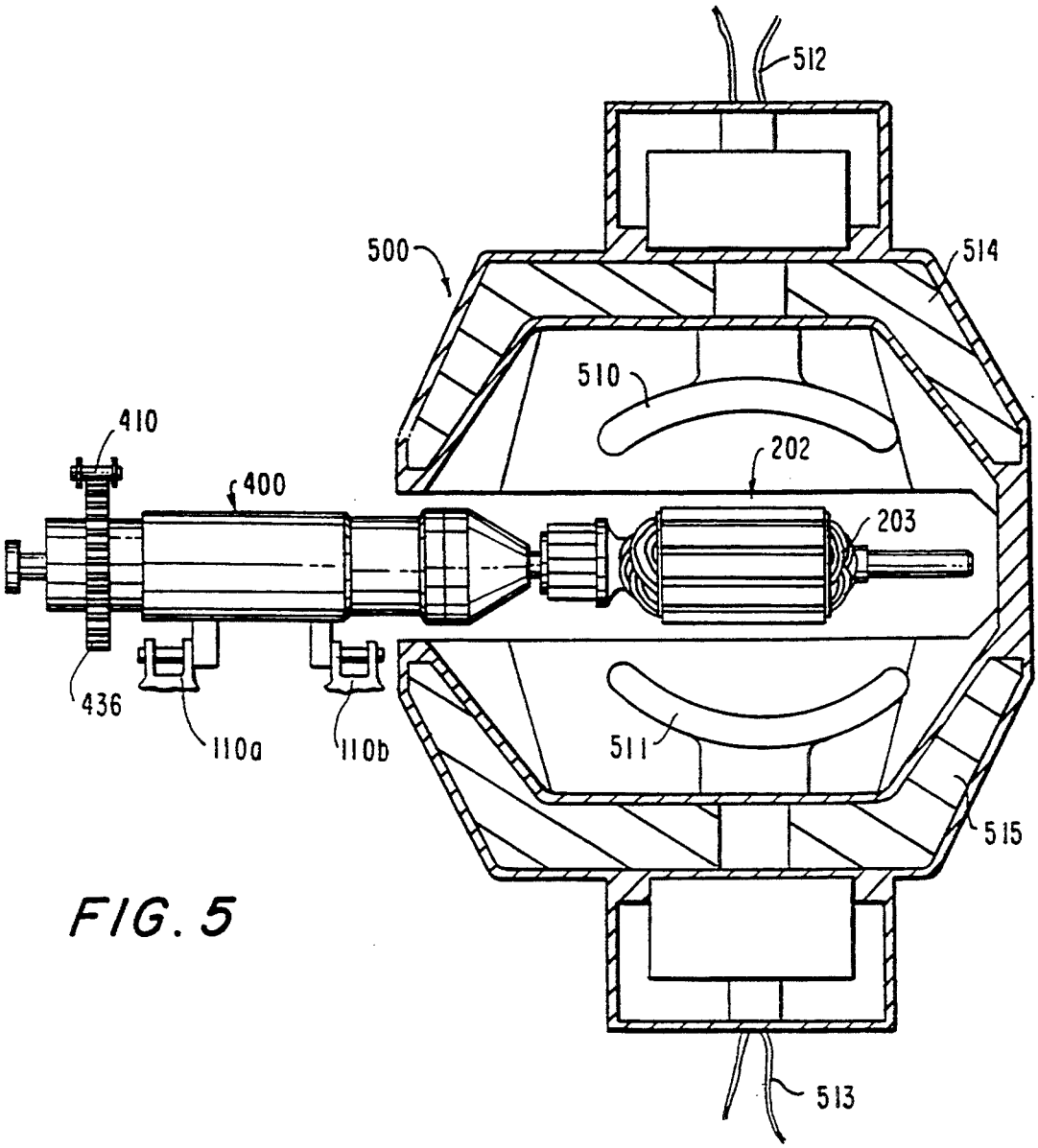
FIG. 5 is a vertical cross-sectional view of a preferred preheating device in accordance with the principles of this invention, taken along line 5—5 of FIG. 1.
Figure 6:
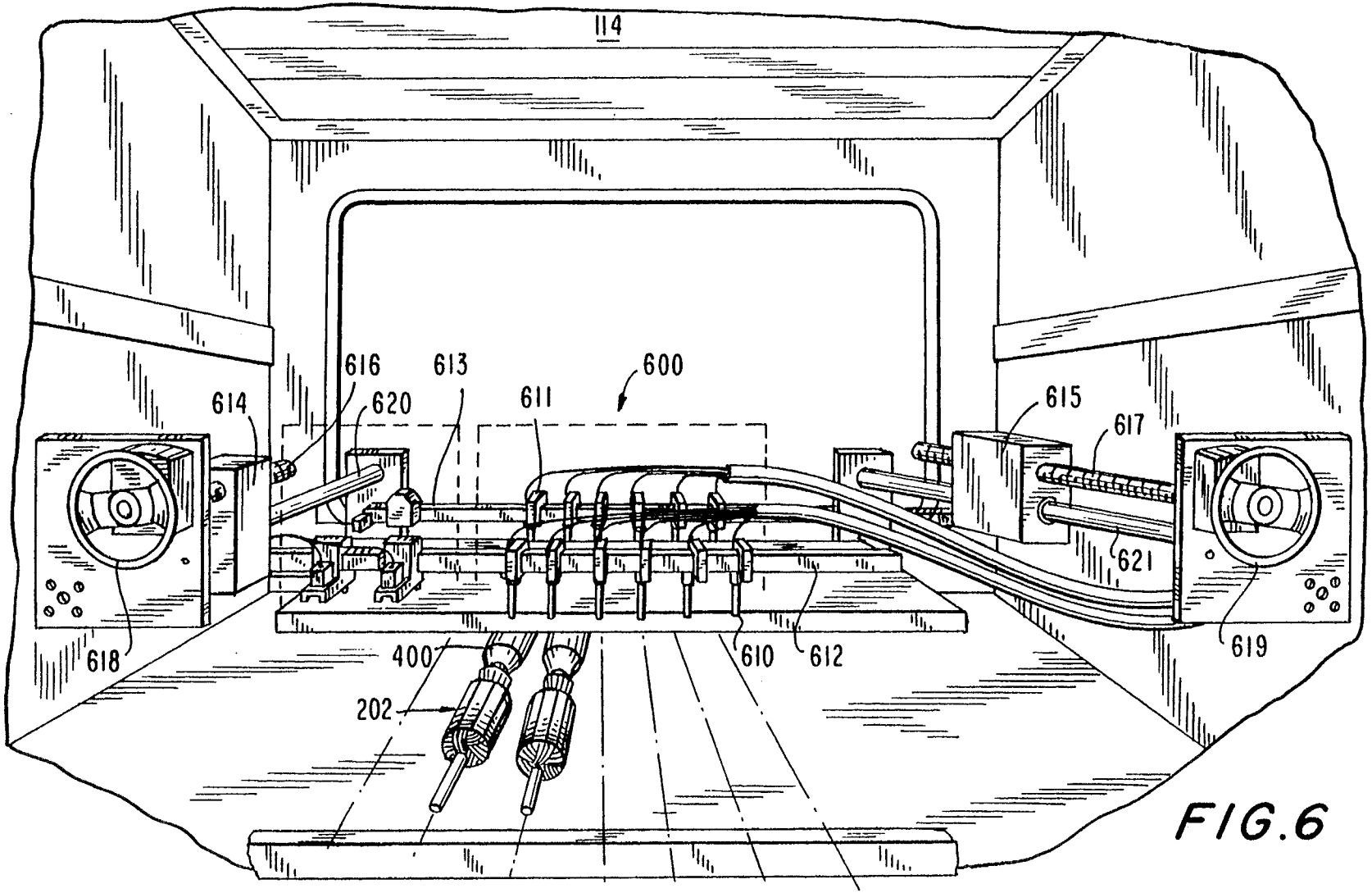
FIG. 6 is a perspective view of a resin coating station of the system of FIG. 1.

A heatless resin coating system in accordance with the principles of this invention is shown in FIG. 1. The system comprises an endless conveyor 110 having two parallel chains **110*a* and 110*b* (only one chain can be seen in FIG. 1 because the two chains are one behind the other when viewed in vertical elevation; both chains are shown in FIGS. 4 and 5). A secondary chain 410 (shown in more detail in FIG. 4) runs parallel to conveyor 110, for reasons described below. Holding devices 400, carried by conveyor 110, hold components to be processed at fixed equal distances from one another so that they can be presented to preheating station 112, resin dispensing/coating station 114, and gelification station 116, successively. As shown in FIGS. 4–6, holding device 400 holds component 202 spaced apart from conveyor chains 110***a* and 110*b* so that only the component and not conveyor 110 or holding device 400 is treated in stations 112 and 114. Conveyor 110 advances with a step-by-step movement to present the components to the various stations at a rate which is dictated by the time required to adequately preheat the components in preheating station 112 and to sufficiently expose the wire coils under the resin dispensers in resin dispensing/coating station 114.

Although the preheating and resin coating stations are shown positioned above the gelification station, those positions may be reversed. In such an arrangement, the heat generated by preheating station 112 will rise to gelification station 116 and hasten the gelification and aging processes. Furthermore, the resin dispensers may be more readily accessible for adjustments and servicing.

Armatures to be coated arrive from upstream processing machines and are transferred to system 100 at transfer station 118. Armatures which have been coated in system 100 are returned to the main conveyor line 206 (shown in more detail in FIG. 2) at transfer station 118 for further processing, usually by the following successive machines: lathe machines, balancing machines, and testing machines. Transfer devices 200 and 300 (shown in FIGS. 2 and 3) transfer coated and uncoated components between system 100 and the main conveyor line.

Figure 2:
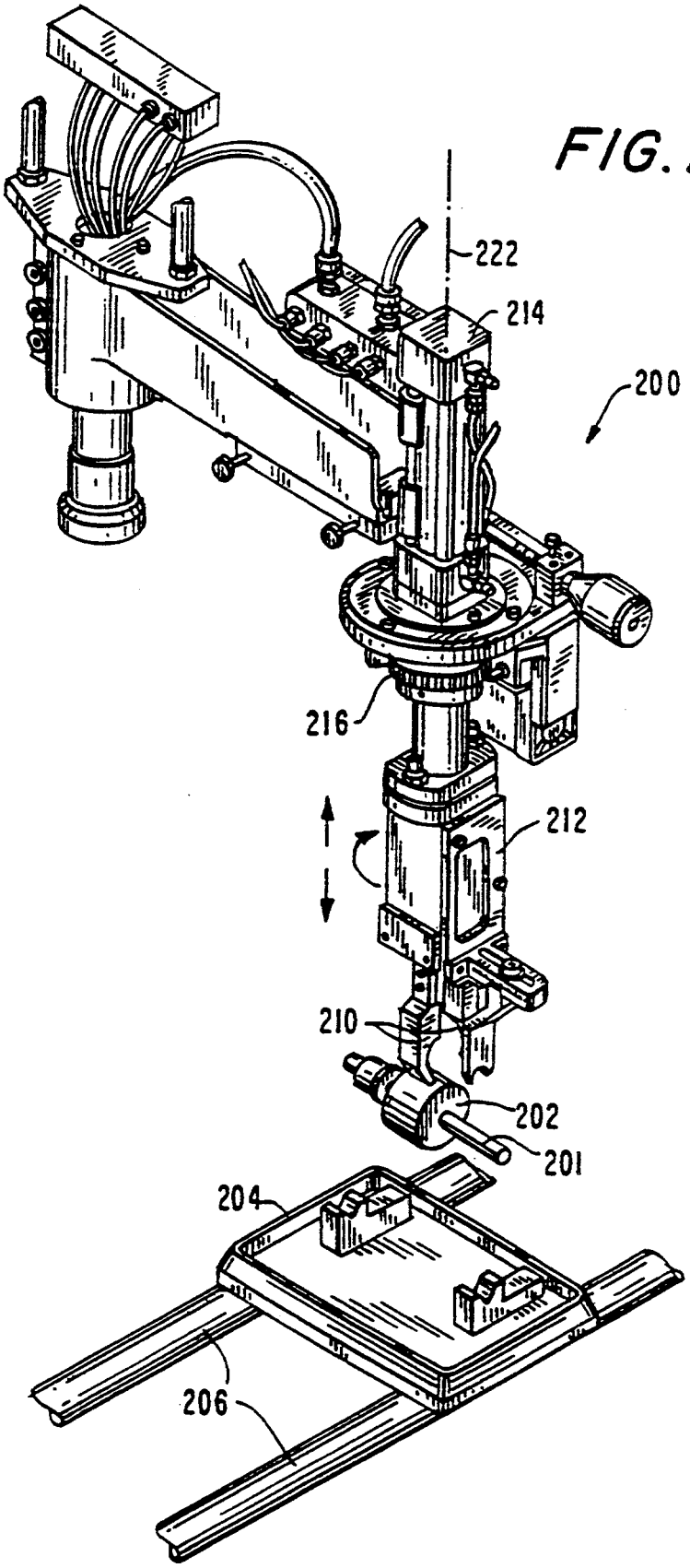
FIG. 2 is an isometric view of a first transfer device for transferring components to and from a main production line.
Figure 3:
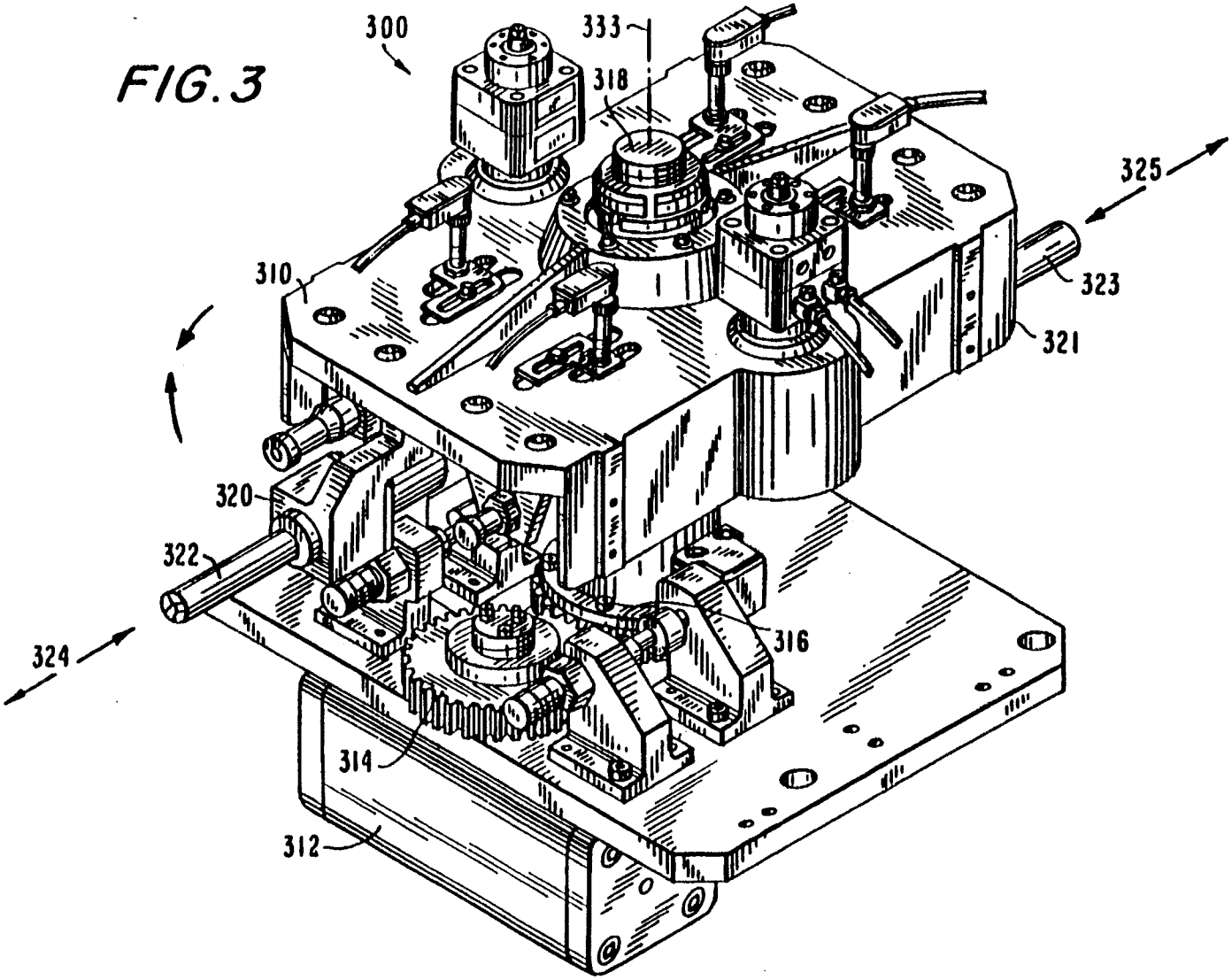
FIG. 3 is an isometric view of a second transfer device for transferring components between the system of FIG. 1 and the main production line, preferably initially to the first transfer device of FIG. 2.

First transfer device 200, shown in FIG. 2, transfers components 202 (shown in the FIGURES as armatures, but which may be any other electric motor component having wire coils, such as stators) between pallets 204 on main conveyor line 206 and transfer device 300 of FIG. 3. Transfer device 200 grips the lamination stack of component 202 by means of opposite grippers 210. An air cylinder (not shown) located in lower structure 212 moves grippers 210 to grip or release the lamination stack of component 202. Lower structure 212 may be vertically translated by means of air cylinder 214 between a lower position required for depositing or picking up component 202 from pallet 204, and an upper position where component 202 becomes aligned with grippers of transfer device 300. Lower structure 212 is also rotatable about axis 222 by means of an integral gear 216 which engages a motorized pinion (not shown), so that either end of component 202 can be presented to the gripper of transfer device 300 depending on how holding device 400 must receive the component.

Second transfer device 300, shown in FIG. 3, transfers components 202 from transfer device 200 to system 100. Second transfer device 300 loads and unloads components to and from the same holding device 400 of system 100 at transfer station 118 when conveyor 110 is stationary to allow resin coating to occur in resin coating station 114. Transfer device 300 has a frame 310 which is rotatable about axis 333 by actuating cylinder 312. Cylinder 312 is connected to gear 314 which, in turn, engages gear 316 fixed to the vertical support axle 318 of frame 310 to thereby rotate frame 310. Two gripper assemblies 320 and 321 are mounted on frame 310, each having respective grippers 322 and 323 which are translatable in parallel but spaced apart planes along travel paths 324 and 325. By rotating frame 312 around axis 333, grippers 322 and 323 alternatively move between these planes to transfer components 202. Along travel paths 324 and 325, grippers 322 and 323 have an innermost position towards frame 310 in order to allow frame 310 to rotate when components 202 have been gripped. Grippers 322 and 323 have an outermost position for placing the grippers proximate to the opposing grippers of transfer device 200 to transfer a component between the transfer devices, or to place the shaft of component 202 within a split collet of holding device 400, as more fully described below.

When a pair of components (one to be coated and another which has already been coated) have been gripped by grippers 322 and 323 of second transfer device 300, frame 310 can rotate to present the coated component to first transfer device 200 and the uncoated component to the holding device positioned at transfer station 218. While one of grippers 322 and 323 of second transfer device 300 is transferring a component to or from first transfer device 200, the other gripper is placing or receiving an armature in or from the Split collet of the holding device at transfer station 118.

Once a component has been transferred to a holding device 400, the component continues to be held by the holding device through the entire coating system, which includes presenting the component to various stations as described above. An illustrative holding device 400, is shown in FIG. 4 joined to chains 110*a* and 110*b* of conveyor 110 and is also coupled to chain 410. Holding device 400 includes a support tube 412 which is fixed to chains 110*a* and 110*b* by pins 414*a* and 414*b* respectively. As discussed above, holding device 400 holds components 202 spaced apart from conveyor 110, and not directly above chains 110*a* and 110*b*, thereby functioning as a cantilever. Chains 110*a* and 110*b* therefore need to be sufficiently supported so that they are not pulled off the conveyor track by the uneven weight of the holding devices gripping components. Preferably, chains 110*a* and 110*b* are securely set in a track and are also covered. Internal tube 416 is mounted inside support tube 412 and outer collet tube 418 is threadedly fixed to one end of internal tube 416. Shaft 420 is mounted inside internal tube 416 and is translatable along axis 444 along travel path 422. Shaft 420 has an enlarged portion 424 for contacting and running on the inside surface of internal tube 416. Split collet 426, fixed to the end of shaft 420 adjacent outer collet tube 418, receives and grips shaft 201 of component 202. Outer collet tube 418 and split collet 426 are dismountable from internal tube 416 and shaft 420, respectively, to be exchanged with a different sized collet tube and split collet for processing components having a different sized shaft.

Preloaded spring 428 is mounted between an abutment ring 430 (also required to guide one end of shaft 420) and shoulder 425 of enlarged portion 424. Spring 428 maintains split collet 426 normally closed to grip shaft 201 by pushing outer conical surface 427 of split collet 426 against the inclined surface 419 of outer collet tube 418. Appendix 432 on the end of shaft 420 opposite split collet 426 can be inserted in fork 434, preferably when the holding device is at transfer station 118, to move split collet 426 to grip or release shaft 201 of component 202.

Sprocket wheel 436 is mounted on the end of holding device 400 at a set distance from chains 110*a* and 110*b*, and adjacent appendix 432. Secondary chain 410, driven by a motor unit, engages sprocket wheel 436 to rotate internal tube 416 and thereby rotate split collet 426 and the gripped component. To achieve this rotation, key connection 438 of sprocket wheel 436 engages mating key ways of internal tube 416. It will be appreciated that sprocket wheel 436 may, instead, mate with and rotate shaft 420.

After components 202 are gripped by holding devices 400 at transfer station 118, the components are conveyed to station 112 to be preheated. Preheating station 112 can heat the wire coils in a short time because the required preheating temperatures are low and less precise than required for traditional resins. Various types of heating devices may be used at station 112, such as: infrared heating devices which heat the entire component, direct electric heaters which contact the commutator bars of armatures to circulate current through the wire coils to heat them by means of a joule effect, or induction heaters which produce an electromagnetic field generated by an alternating current generator which in turn produces heat as the direct electric heaters do.

In the system shown in FIG. 1, where the conveyor moves at a required production rate compatible with times for heating the components and applying resin, the use of heatless resins makes it possible to use small sized heaters which heat a small number of components at the same time. This situation is practically the opposite of what occurs when treating components with traditional resins which require heating to higher temperatures (thus requiring more energy) and a more precise tolerance. Accordingly, while heaters for traditional resins are typically large air convection ovens with long stretches of transfer conveyors for heating a large number of components at the same time (thus occupying a large floor area, and requiring large, expensive equipment, and long, expensive conveyors), heaters for heatless resins are small and rather compact (thus less complex and less expensive).

An illustrative infrared preheating device 500, shown in FIG. 5, uses infrared elements 510 and 511 to heat the wire coils of component 202. Infrared elements 510 and 511 are positioned above and below component 202 and extend parallel to conveyor chains 110*a* and 110*b*. A series of infrared elements can be placed one after the other in order to reach the necessary preheating capacity and allow the components to reach the required temperature. Each infrared element 510, 511 is connected to an electric power supply line 512, 513, respectively, to produce infrared radiation emissions which heat the coils. A regulator circuit using temperature sensor feedback can be used to adjust the power for these elements in order to keep the temperature of the wire coils as close to the required level as possible. Reflector surfaces 514 and 515 aid in concentrating the infrared radiations on the coils of the armature. To uniformly heat the coils of the armature, the armatures are rotated by moving secondary chain 410 which engages the sprocket wheels 436 of the holding devices 400.

The preheated components are then passed into the resin dispensing/coating station 114. Resin is successively applied to each component by a series of resin dispensing tubes so that each component is gradually coated during passage through resin coating station 114. Preferably, the components are rotated throughout the resin application process.

A typical resin coating station, and the resin application apparatus used in such a station are shown in FIGS. 6–10. It will be understood that the disclosed station is useful for the application of either heatless or traditional resins. Resin application apparatus 600 of FIG. 6 includes a resin dispenser tube 610, 611 aligned with each wire coil end of a component 202 to be coated (any of the resin dispensers shown in FIGS. 7, 8, or 10 may be used). The resin dispensers on one side of the components are mounted on common mounting 612 while the resin dispensers on the other side of the components are mounted on common mounting 613. The two mountings are movable with respect to one another transverse to the extensions of chains 110*a* and 110*b* (i.e., parallel to the longitudinal axes of the components) in order to coat components of different lengths which accordingly have wire coils spaced apart by different distances. To accomplish such displacement, mountings 612 and 613 are mounted on respective slides 614 and 615 which can be driven by screws 616 and 617 commanded by handwheels 618 and 619. Guides 620 and 621 are also provided to allow movement of the slides.

Figure 7:
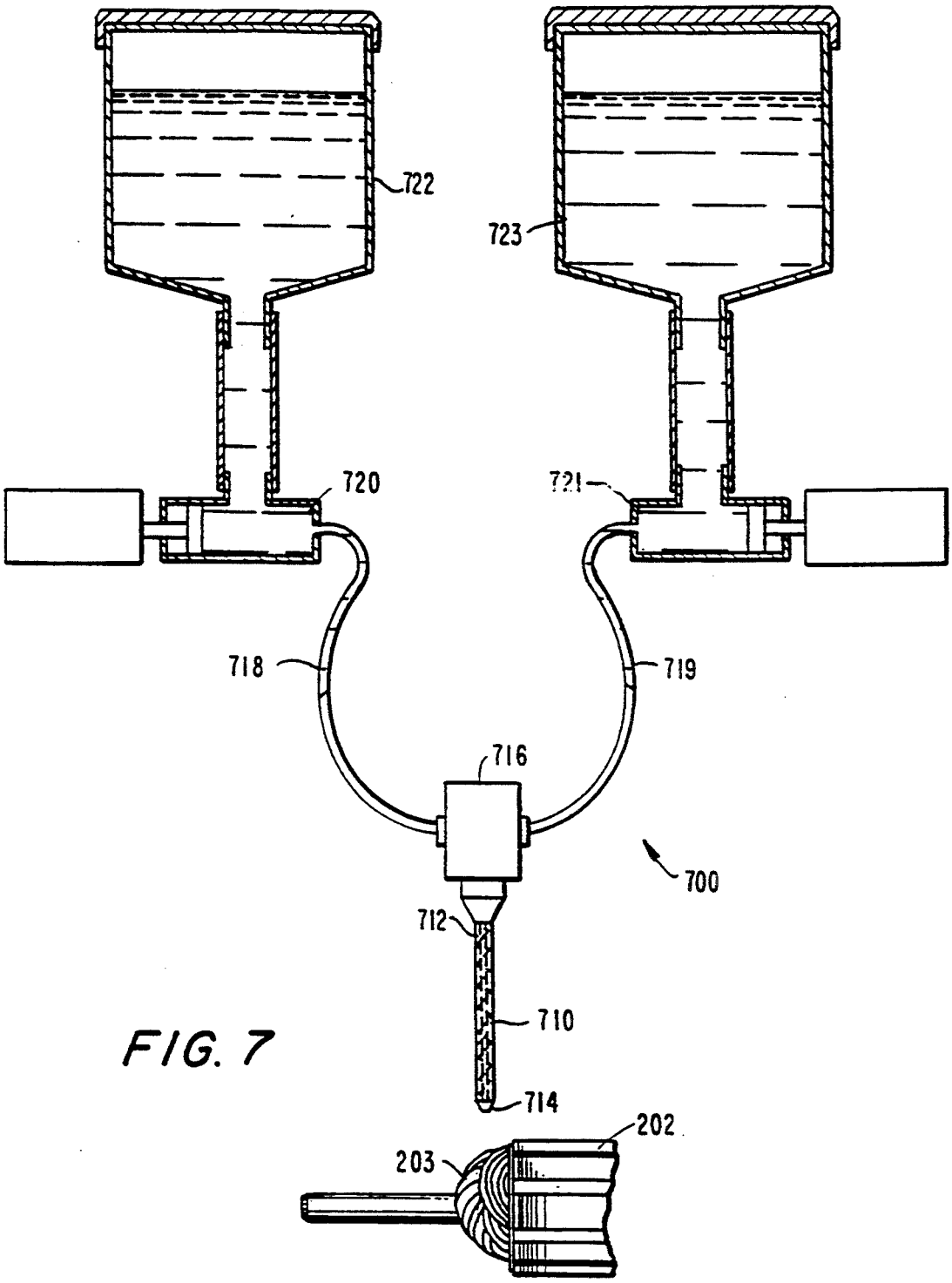
FIG. 7 is a schematic elevational view, partly in section, of a resin dispenser which may be used in the resin coating station of FIG. 6.

A resin dispenser 700, which may be used in resin application apparatus 600, is shown in FIG. 7. Resin dispenser 700 includes a mixer and dispenser tube 710 having internal inserts 712 which form a helical path for the resin when it flows to reach outlet 714 from which the resin is dropped on a coil 203 of component 202. Mixer and dispenser tube 710 is supplied by distributor 716 which is fed by supply tubes 718 and 719 (separately supplying resin and catalyst). Piston pumps 720 and 721 respectively feed supply tubes 718 and 719 from pots 722 and 723 (separately containing resin and catalyst). Up to the outlet of distributor 716 where mixer and dispenser tube 710 is connected, the catalyst and the resin are always separate. As described above, the resin and the catalyst are only mixed as they enter mixer and dispenser tube 710 where the helical path causes a highly efficient mixing operation when they flow together. After the catalyst has been added, the exothermic reaction causes the resin to harden in precise and rapid timing. The activation of piston pumps 720 and 721 therefore must be carefully time controlled to prevent the resin from hardening before leaving mixer and dispenser tube 710.

Figure 8:
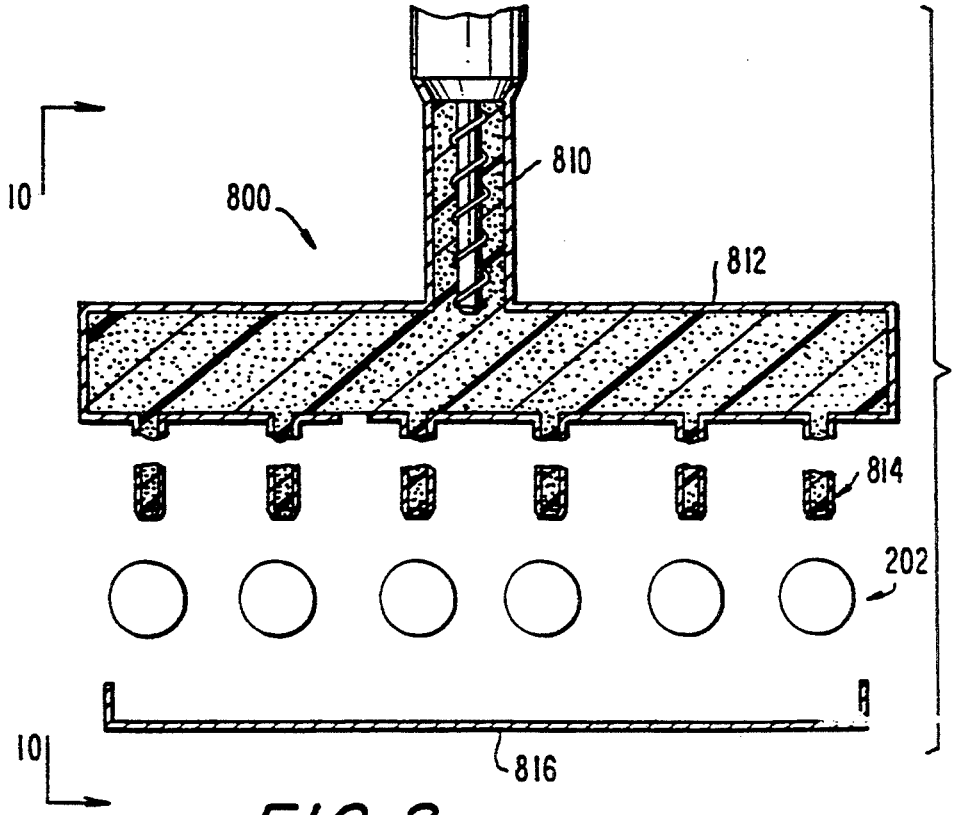
FIG. 8 is a schematic elevational view, partly in section, of a resin dispensing system serviced by a single set of pumps and capable of simultaneously dispensing resin to a plurality of separate components.

An alternative resin dispenser system 800 for use in resin application apparatus 600 is shown in FIG. 8. In order to reduce costs and to coat components uniformly through resin coating station 114, a single set of pumps may be used for each side of a component to be coated. Thus, pumps, such as shown in FIG. 7, supply a single mixer tube 810, in which the resin and catalyst are mixed. The catalyzed resin is then fed to manifold 812, which, in turn, feeds a plurality of resin dispenser tubes 814. Each dispenser tube 814 applies resin to a separate component in resin coating station 114. Excess resin is collected by collecting tray 816 (which is preferably used in system 114, regardless of the dispenser being used). Because each dispenser tube 814 is serviced by the same set of pumps, incremental resin applications to one side of a component will be uniform as the component passes through station 114. The reduced number of pumps required by system 800 also greatly reduces the cost of resin coating station 114. Preferably, mixer tube 810, manifold 812, and dispenser tubes 814 are made from the same mold, and thus are easily replaceable as a unit.

Figure 9:
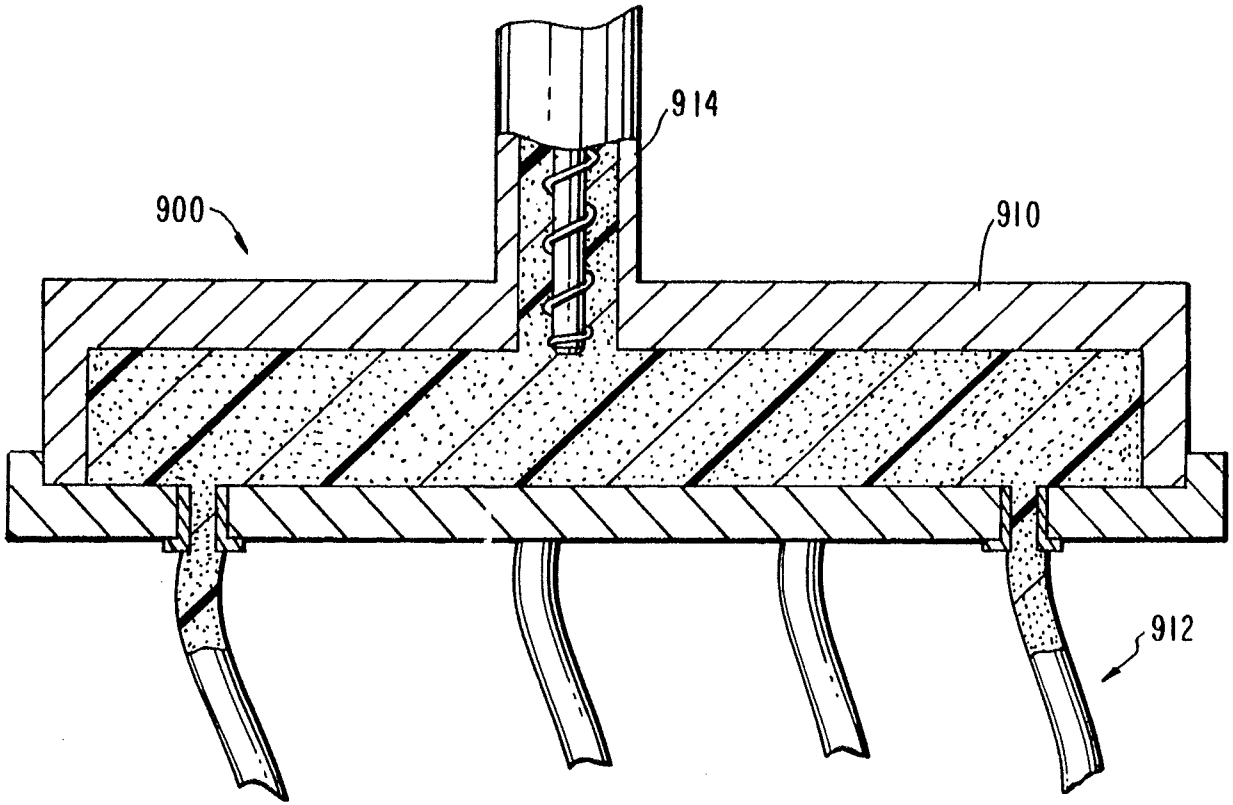
FIG. 9 is a schematic elevational view, partly in section, of a resin dispensing system similar to, but more compact than, the system of FIG. 8, and having long flexible dispensing tubes.

Another alternative resin dispenser system 900 which may be used in resin application apparatus 600 is shown in FIG. 9. Manifold 910 is cylindrical and extremely compact, and does not extend along the entire length of the area along which components are coated. Flexible long tubes 912 are used to reach the various positions at which components in station 114 are to be coated. As with manifold 810, a common mixer tube 914 feeds resin to manifold 910. While the same compact mixer tube 914 and manifold 910 may be used for any size resin application apparatus, the lengths of each flexible long tube 912 must be selected to extend along the length of a given resin application apparatus. Accordingly, mixer tube 914 and manifold 910 are preferably made from the same mold, and thus are easily replaceable as a unit, while flexible long tubes 912 are preferably separate pieces, attached to the manifold once the length of the application apparatus is known.

Figure 10:
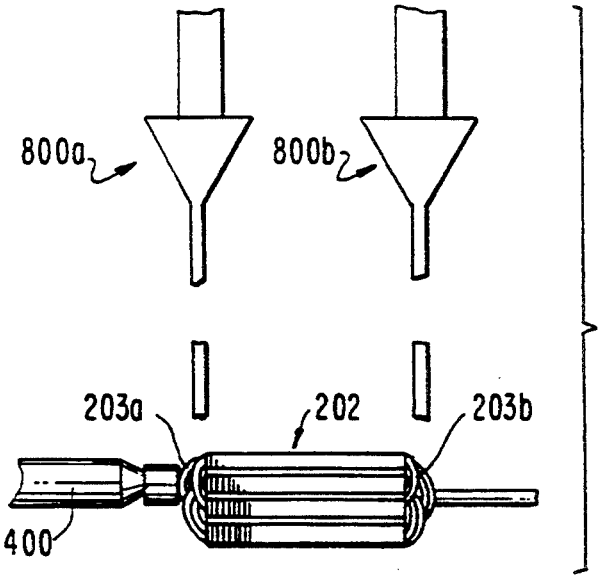
FIG. 10 is a schematic side view of FIG. 8, along line 10—10.

As discussed above, a set of resin dispensers is provided on each side of the component to be coated. Preferably, the resin dispensers on one side of the components being coated are controlled separately from the dispensers on the other side of the components being coated to allow each side to be coated differently, if desired. A separate system 800*a*, 800*b* for each end 203*a*, 203*b* of the wire coils on component 202 is illustrated in FIG. 10.

The pumps which feed the resin dispensers of FIGS. 7–9 carry out periodic strokes to keep the dispenser tubes supplied with resin. While conveyor 110 indexes the components, the pumps are stopped to prevent resin from dropping on components that are moving from one dispenser tube to another. Usually the resin will not harden if the pumps are stopped during such indexing. However, during the time required to coat a component or during any other operation which is longer than the critical period necessary for hardening, the pumps must continue functioning to keep the resin flowing and prevent irreversible hardening of the resin in the mixer tubes.

After being coated in resin coating station 114, the components are transported at room temperature through gelification station 116 up to transfer station 118. During transport through gelification station 116, the components preferably are rotated to guarantee that the resin will dry uniformly, and will not aggregate in certain areas due to gravitational effects.

As described above, once coating of a component has been initiated, the resin needs to be applied to the coils in precise quantities and in prescribed timing. Otherwise, the components can be damaged due to premature hardening of resin before they are completely coated by the resin dispensers. However, continuous application of resin may not always be possible. Unusual conditions present in the main conveyor line upstream or downstream of transfer station 118 may create a lack of synchronization between the main conveyor line and the need of coating system 100 to unload coated components. For example, there may not be enough components upstream of transfer station 118 to be supplied to coating system 100, or the systems downstream of transfer station 118 may not be able to accept any more coated components for a while. If coating system 100 is accordingly halted, the components would be left under the dispensers for a time sufficient for hardening of the resins, resulting in unusable components. Thus, it is preferable to allow conveyor 110 to continue to advance through coating system 100, carrying the coated component which cannot be unloaded at transfer station 118 past transfer station 118. Only when synchronization with the main production line occurs again will coated components once again be unloaded from holding device 400 on conveyor 110 and switched with an uncoated component at transfer station 118. If a coated component must pass transfer station 118 and reapproach resin coating station 114, resin is prevented from being applied to the coated component, as will be described below.

Figure 11:
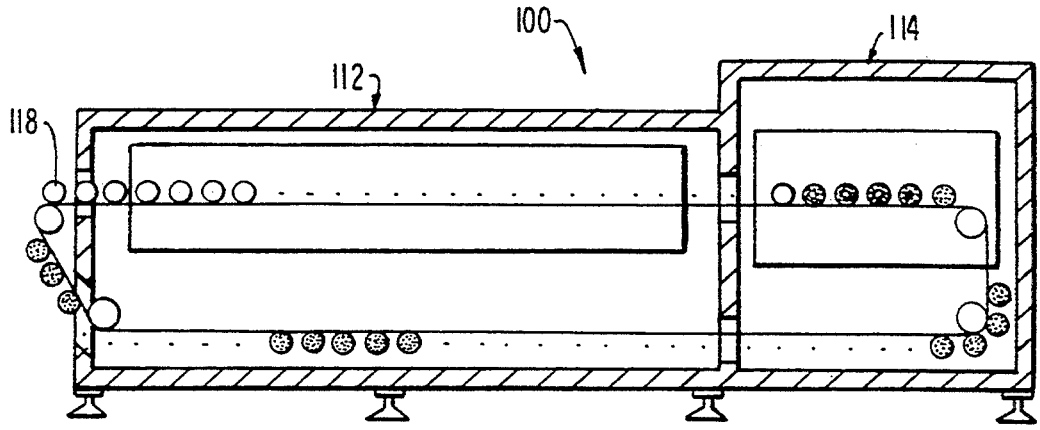
FIG. 11 is a schematic elevational view of the system of FIG. 1, showing the system synchronized with the main conveyor line.
Figure 12:
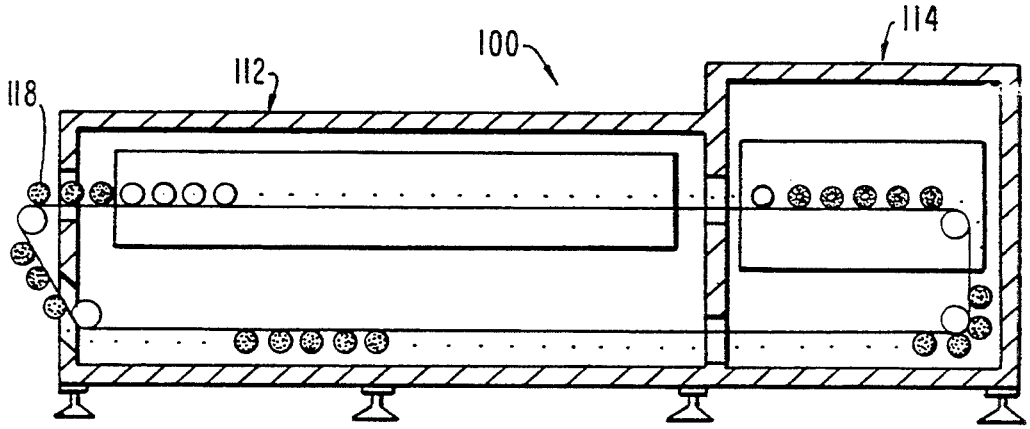
FIG. 12 is a schematic elevational view of the system of FIG. 1, showing the beginning of a situation in which coated components are not unloaded at the unloading station.
Figure 13:
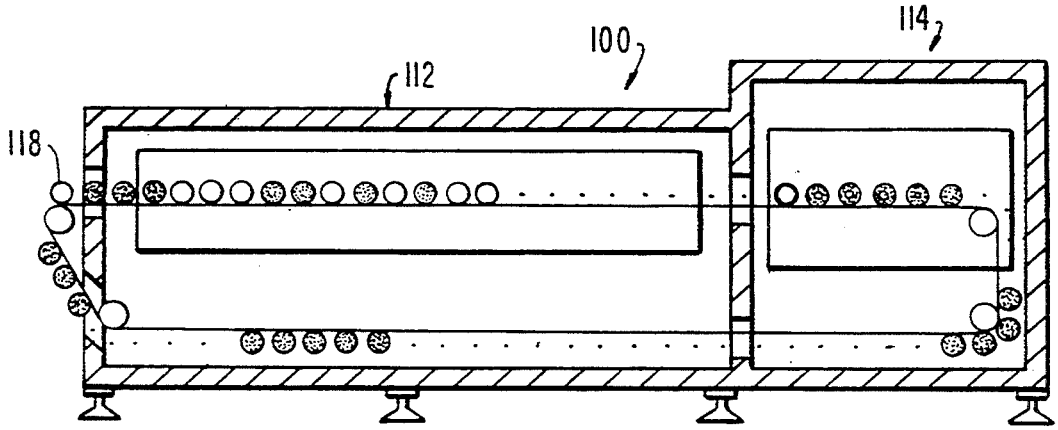
FIG. 13 is a schematic elevational view of the system of FIG. 1, showing the system periodically not synchronized with the main conveyor line so that a random distribution of coated and uncoated components approach the resin coating station of FIG. 6.

Various situations that can develop in coating system 100 in connection with synchronization with the main production line are shown in FIGS. 11–13. In these FIGURES, components to be coated are unshaded, and components which are partially or completely coated are partially or completely shaded, respectively.

In FIG. 11, coating system 100 is synchronized with the main conveyor. Therefore, coated components may be unloaded, and uncoated components are ready to be loaded at transfer station 118. Coated components are not in danger of passing again through resin coating station 114.

Figure 15:
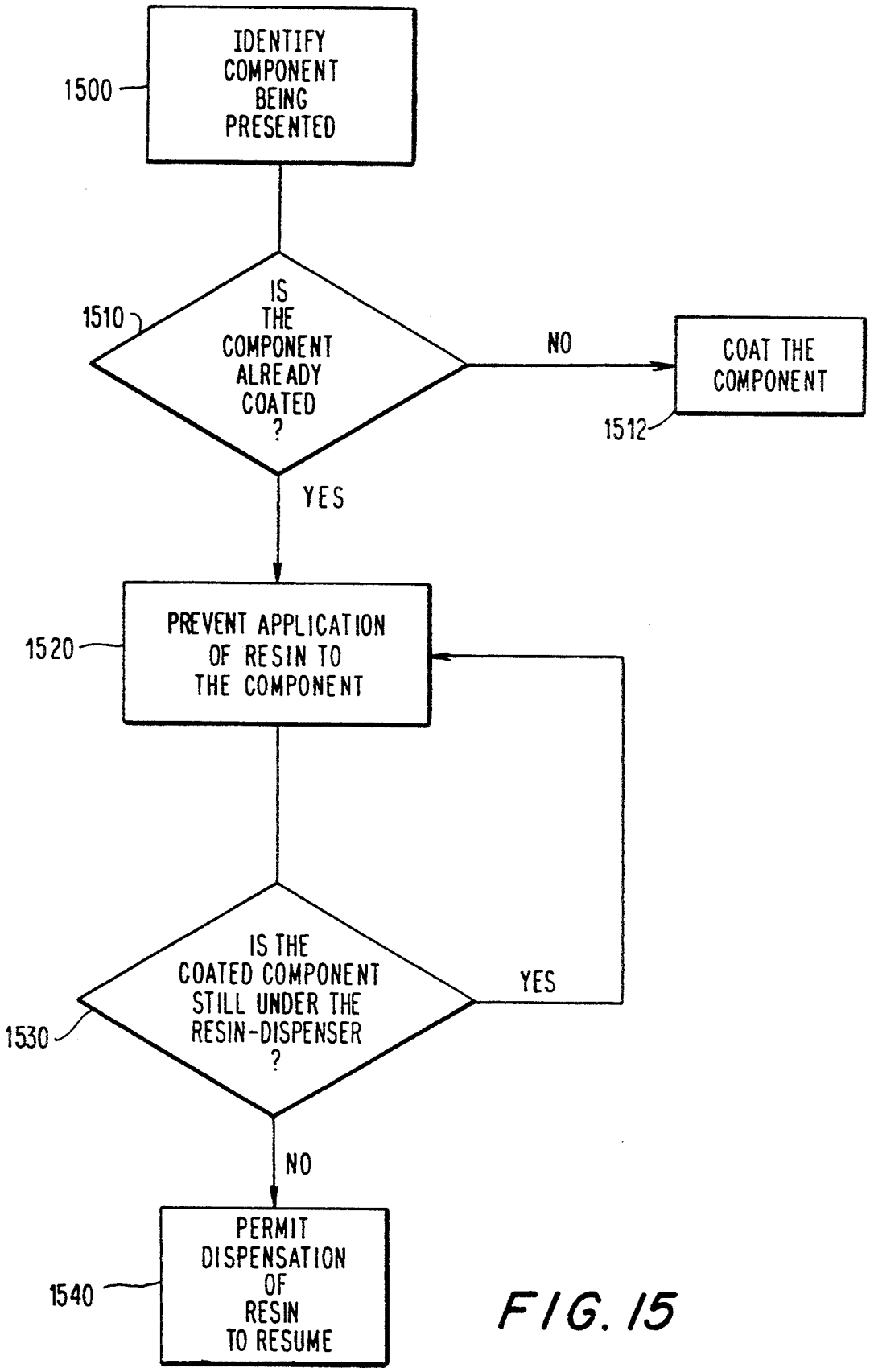
FIG. 15 is a flow chart showing the steps carried out to manage the resin dispensers at the resin coating station of FIG. 6.

The beginning of an unsynchronized situation is shown in FIG. 15. Coated components were not unloaded at transfer station 118, either because no uncoated components were ready upstream, or because the downstream equipment was not ready to accept another coated component. Therefore, coated components have had to progress past transfer station 118.

A situation caused by several successive instances of lack of synchronization for short periods of time is shown in FIG. 13. Accordingly, a random distribution of coated and uncoated components progress from transfer station 118 to resin coating station 114.

Because of the requirements discussed above, coating of partially coated components shown in FIGS. 12 and 13 must be completed, while the coated components which have passed transfer point 118 must not be recoated. Therefore, resin application apparatus 600 must continue to dispense resin on partially uncoated components, but prevent resin from flowing onto coated components which are also present. The flow charts of FIGS. 14 and 15 show typical control steps to be taken in order to manage the situations of FIGS. 12 and 13.

Figure 14:
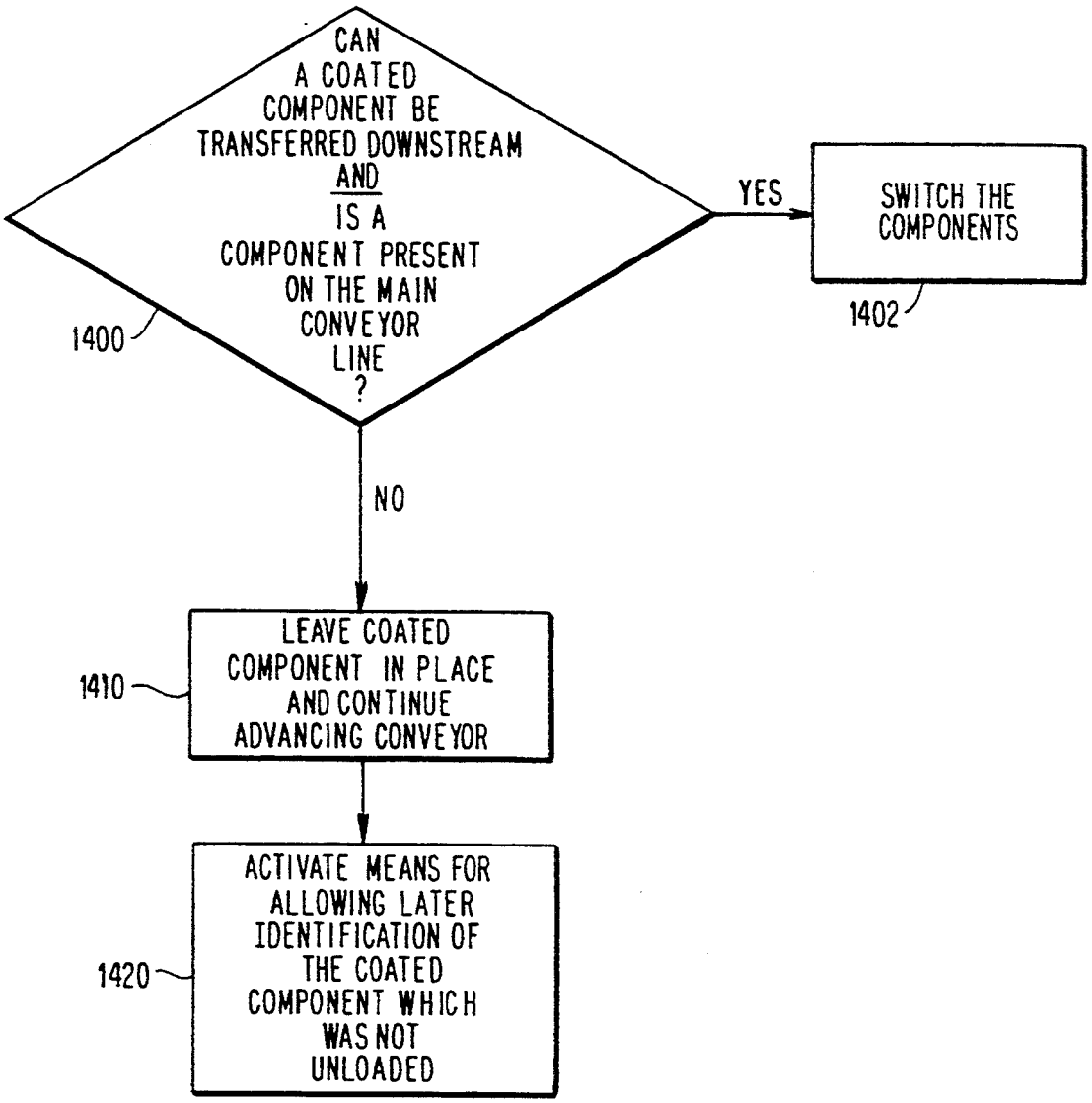
FIG. 14 is a flow chart showing the steps carried out at the loading and unloading station of the system of FIG. 1.

Control steps taken for managing loading and unloading operations when a coated component arrives at transfer station 118 are shown in FIG. 14. At test 1400, the system verifies synchronization with the main conveyor line by determining upstream and downstream conditions. As discussed above, a transfer can occur only if downstream equipment is ready for the coated component at transfer station 118 and also if an uncoated component is ready to be transferred to coating system 100. If the main conveyor line is synchronized with coating system 100, then at step 1402 the coated and uncoated components exchange places at transfer station 118. If, however, at test 1400, the main conveyor line is not synchronized with coating system 100, then at step 1410 the coated component is left in holding device 400 and continues to advance on conveyor 110. Additionally, means for allowing later identification of the coated component which could not be unloaded are activated at step 1420.

Such means for identifying the coated component requires that coating system 100 be capable of recognizing whether a specific holding device carries a coated or uncoated component. This recognition capability may be accomplished with any or several of the following identifying means (or their equivalents): a microprocessor, a simple counting means, or a mechanical/electronic identification/coding means on the holding device itself. Each of these identifying means are well known in the art.

A microprocessor may have a simple shift register memory for storing the condition of the component held by the associated holding device. Each position in the register is associated with a particular holding device 400 or position on conveyor 110. The shift register has at least as many positions as are present from transfer point 118 to the end of resin coating station 114. Information is added to the shift register at transfer point 118 and checked at coating station 114. Data in the shift register is shifted after each increment of conveyor 110 so that the content of the shift register is constantly modified.

Alternatively, a counting device may be used which starts counting increments of conveyor 110 each time a coated component passes transfer station 118 to determine when the coated component reaches resin coating station 114 so that dispensing of resin onto the coated component may be prevented. If desired, a shift register may be used until the components enter resin coating station 114, in which a counter would identify coated components thereafter.

If, instead, the holding device itself is to be physically identified (typically when a memory or counter is not used), a coding device 440 may be located on the outer portion of holding device 400, such as shown in FIG. 4. Coding device 440 is triggered at transfer station 118 to indicate the status (i.e., coated or uncoated) of the component being carried away. Coding device 440 is then read along the conveyor path by sensors such as sensor 442 shown in FIG. 4. Sensors 442 may be located at any point in system 100, and preferably are at least located at the entrance of resin coating station 114 or at each resin dispenser in resin application apparatus 600, depending on the type of identification means being used. Thus, for example, if a shift register is used, then there would only be a sensor at the entrance of station 114. But, if no shift register is used and each holding device has a coding device 440, then a sensor would be required at each controllable resin dispenser.

When a coated component enters resin coating station 114 (determined by any of the above-described identifying means), means for preventing resin flow must activated, and continue to prevent resin flow until an uncoated component enters the station. Control steps required for managing each of the resin dispensers of resin application apparatus 600 in resin coating station 114 are shown in FIG. 15. First, the component being presented to a resin dispenser is identified at step 1500 to determine, at step 1510, whether the component is coated or not coated. If the component has not yet been coated, then it is coated at step 1512. However, if the component has already been coated, then application of resin to that component is prevented at step 1520, as described in more detail below. Because typically several dispensers are present in resin coating station 114, the presence of a coated component is constantly monitored at test step 1530 so that application of resin to the coated component is prevented as the coated component passes sequentially under the resin dispensers in the station. Only when the coated component leaves a resin dispenser is that dispenser permitted to resume applying resin, at step 1540. Conveyor 110, as described above, continues to move the components along at a predetermined rate required for proper coating of an uncoated component throughout the above steps.

Application of resin may be prevented in at least four ways. First, pumps 720 and 721 may be stopped to prevent supply of resin and catalyst to the mixer tube and thereby prevent further application of resin. Second, a resin diverting tray may be positioned between a dispenser tube and a coated component thereby allowing resin to continue to flow (thus preventing resin from hardening in the mixer tube) yet preventing recoating of a coated component. Third, if the resin dispenser tubes are flexible, then the resin dispenser tubes may be displaced along the path of conveyor 110 so that the resin being dispensed is not applied to the coated armature. Finally, a combination of any of the above may be used sequentially, as described below. The second and third means are particularly useful for selectively preventing resin flow from a plurality of mixer tubes serviced by a common pump so that while flow onto a coated component is prevented, an uncoated components may continue receiving a coat of resin.

Figure 16:
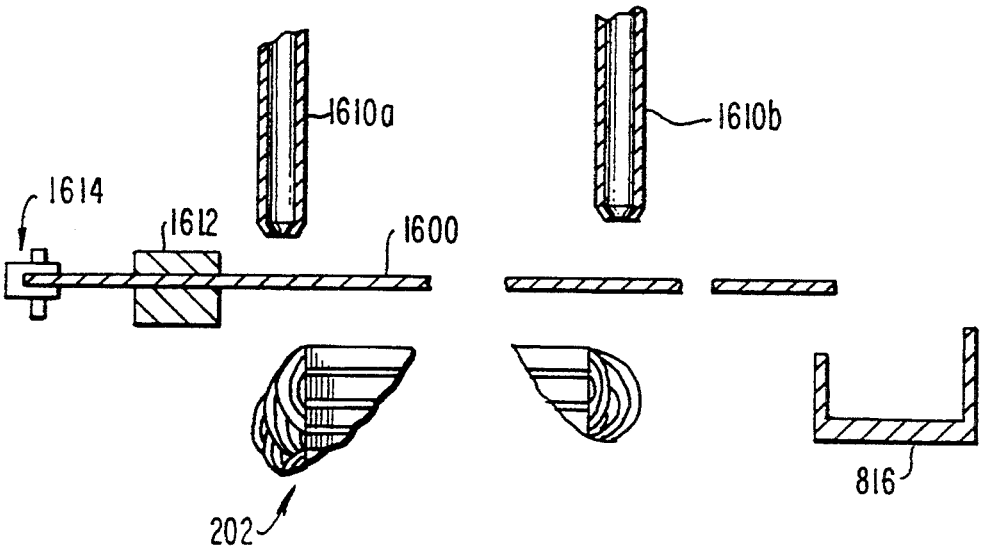
FIG. 16 is a schematic side view of the resin dispensing portion of the resin coating station of FIG. 6.

Apparatus for preventing the application of resin in the second above-listed method is shown in FIG. 16. An inclined resin diverting tray 1600 is inserted between dispenser tubes 1610*a* and 1610*b* and a coated component to divert the flow of resin from being applied to the coated component. A diverting tray 1600 is provided for each set of dispenser tubes which coats the same component. The resin may be diverted to a collecting tray 816 (shown in FIG. 8 as well). Diverting tray 1600 is supported by guides 1612 and moved by actuator 1614, as needed. Each diverting tray 1600 preferably is independently controlled to only affect application of resin to a single component, so that application of resin to uncoated components adjacent coated components will not be affected.

Figure 17:
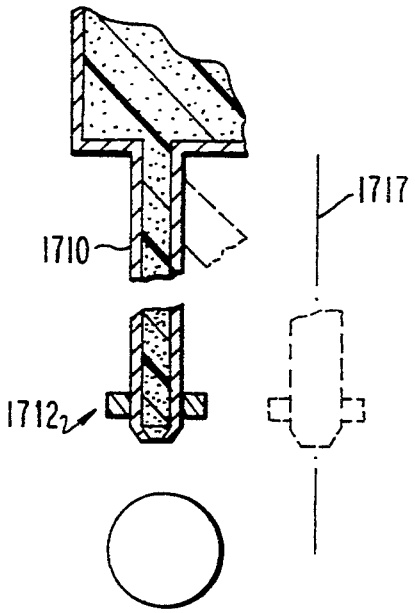
FIG. 17 is a schematic elevational view, partly in section, of a flexible, displaceable dispenser tube of a resin dispensing system such as shown in FIG. 8.

Apparatus for preventing the application of resin in the third above-listed method is shown in FIG. 17. If flexible dispenser tubes 1710 are used, then each tube may be deflected by means of deflecting actuator 1712 when a coated component is positioned beneath dispenser tube 1710. Flexible dispenser tube 1710 may thus be moved to axis 1717, between adjacent components positioned for application of resin, so that resin will flow into collecting tray 816 (shown in FIGS. 8 and 16) instead of onto a coated component.

With respect to the situation shown in FIG. 13, in which coated and uncoated components are randomly distributed, careful record of the status of the component held by each holding device must be kept. When a coated component passes beneath a resin dispenser, if the dispenser shares a common pump with several other dispensers (which may be the case in view of pump cost considerations), then the insertion of a resin diverting tray between the mixer tube and the coated component, or the displacement of dispenser tubes (if the dispenser tubes are flexible) is preferable. Alternatively, if each resin dispenser is controlled by its own pump, then the individual dispenser beneath which a coated component is positioned may be stopped. However, if the resin being used hardens extremely rapidly, then stopping the pumps while conveyor 110 has stopped to allow coating of other components in resin dispensing/coating station 114 may allow the resin left in the mixer tube of the stopped dispenser to harden and block later passage of resin. Accordingly, unless the mixer tube may be replaced rapidly to allow for coating of the next uncoated component to pass below that dispenser, insertion of a resin diverting tray or displacement of flexible dispenser tubes is preferable. Moreover, constant stopping and starting of the pumps may create nonuniform applications from component to component, and insertion of a resin diverting tray or displacement of dispenser tubes may be preferable in any event.

If coated components are allowed to pass transfer point 118 each time the main conveyor line and coating system 100 are not synchronized (creating a random distribution of coated and uncoated components such as shown in FIG. 13), then coating system 100 will tend to have a rather high incidence of coated components passing transfer point 118. If many coated components pass through resin coating station 114, then preventing recoating of such components will either result in a lot of lost resin (if the resin or the tubes are diverted) or nonuniform resin coating (if the resin pumps are constantly stopped and restarted). It therefore is preferable to stop all activities at transfer station 118 once the first coated component has passed until all components on conveyor 110 have been coated. This approach would result in losing resin from the dispensers of resin application apparatus 600 only for the time required to completely coat a single component. Additionally, the resin pumps preferably are stopped only once, after all uncoated components in system 100 are coated. Any dispenser parts blocked with hardened resin may be replaced during the time required for an uncoated component loaded at transfer point 118 to reach resin coating station 114.

A situation in which activities at transfer station 118 are stopped while conveyor 110 progresses and other stations continue to function as usual is shown in FIG. 12. No further coated components are removed from system 100 until all of the remaining uncoated components in system 100 have been coated. Thus, once the first coated component arrives at resin application station 114, dispensing of resin is sequentially prevented until the last uncoated component has exited station 114, and all components in system 100 have been coated. For example, if a single common pump is used on each side of component 202, then resin diverting trays 1600 may be inserted sequentially (or, if flexible dispensers tubes are used, the tubes may be sequentially diverted) until the common pump may be stopped. Once all components in system 100 have been coated, the pumps preferably are stopped, until loading and unloading of components at station 118 resumes. During the time required for conveyor 110 to advance an uncoated component from transfer station 118 to the first resin dispenser of station 114, mixer tubes 610, 611 may be flushed to remove hardened resin, or replaced. The mixer tubes, manifolds, and dispenser tubes of FIGS. 7–9 can be made of inexpensive polyurethane composites, or other low cost materials suitable for the resins being used, so that they may be discarded if they become contaminated with an irreversibly hardened resin without incurring great expenses. This method therefore is designed to allow adequate time to change any dispenser parts which may become clogged while dispensing is stopped to prevent recoating.

As discussed above with respect to FIG. 13, hardening of resin in the mixer tube or uneven application of resin to successive components may occur if the pumps servicing the dispenser are periodically, and continuously turned off and then restarted. Accordingly, it is preferable to utilize the resin diverting trays discussed above, or to displace flexible dispenser tubes unless resin dispensing may be stopped for a long enough period of time to replace blocked parts. Thus, if all transfers at transfer station 118 are halted until all uncoated components are coated, then as a coated component progresses under a series of commonly serviced resin dispensers, resin diverting trays are inserted or dispenser tubes are displaced to prevent resin application onto the coated component until only coated components are under the series and the common pump can be stopped.

It will be understood that the foregoing is merely illustrative of the principles of the invention, and that various modifications can be made by those skilled in the art without departing from the scope and spirit of the invention. For example, the components (in the FIGURES, armatures), transfer devices, preheating devices, and resin dispensers shown and described above are illustrative, and any equivalent device may be used instead. Likewise, components may be carried by means other than the holding devices shown and described above. The described embodiments are presented for the purpose of illustration rather than limitation, and the present invention is limited only be the claims which follow.

What is claimed is:

1. A resin coating system comprising:

a coating station for dispensing resin and applying the resin to uncoated components, said coating station comprising a plurality of resin dispensers for applying resin to said components in said coating station and means for preventing coating of a coated component in said coating station by preventing dispensing of resin from an individual resin dispenser onto a coated component while uncoated components in said coating station continue to be coated with resin;

a gelification station downstream of said coating station in which the resin on components coated in said coating station solidifies;

a transfer station at which components to be coated are loaded for transfer into said coating station and components which have been coated and have passed through said gelification station are unloaded after transfer out of said gelification station; and an endless conveyor for conveying components through said coating station, said gelification station and said transfer station.

2. The resin coating system of claim 1 wherein:

at least one of said resin dispensers dispenses heatless resin; and said heatless resin solidifies through an exothermic chemical reaction, thereby hardening at room temperature.

3. The resin coating system of claim 1 further comprising a transfer device at said transfer station for transferring uncoated and coated components between a main conveyor line and said endless conveyor.

4. The resin coating system of claim 3 wherein:

said transfer device has a first side positioned adjacent one of said main conveyor line and said endless conveyor and a second side positioned adjacent the other of said main conveyor line and said endless conveyor;

each of said first and second sides has a site for gripping a component; and said transfer device is rotatable so that a component initially located at one of said main conveyor line and said endless conveyor may be gripped by said transfer device and moved to the other of said main conveyor line and said endless conveyor.

5. The resin coating system of claim 1, further comprising a preheating station, between said transfer station and said coating station, in which said uncoated components are heated before being coated with resin.

6. The resin coating system of claim 5, wherein said preheating station comprises infrared heaters.

7. The resin coating system of claim 1, further comprising means for rotating said components in at least one of said coating station and said gelification station.

8. The resin coating system of claim 7, wherein said rotating means rotates said components in said coating station.

9. The resin coating system of claim 7, wherein said rotating means rotates said components in said gelification station.

10. The resin coating system of claim 1, further comprising holding devices carried by said endless conveyor for holding said components throughout said coating system.

11. The resin coating system of claim 10, wherein said holding devices rotate said components about the longitudinal axes of said components.

12. The resin coating system of claim 10, wherein said holding devices each comprise a split collet for gripping a portion of said component and a collet tube positioned around said split collet and translatable along the longitudinal axis of said holding device to cause said split collet to grip said portion of said component.

13. The resin coating system of claim 12, further comprising actuating means acting on said collet tube for causing said collet tube to translate along said longitudinal axis of said holding device.

14. The resin coating system of claim 12, further comprising a support tube in which said split collet and said collet tube are positioned and supported.

15. The resin coating system of claim 14 wherein said split collet and said collet tube are releasable from said support tube for exchange with a split collet and collet tube for gripping different sized components.

16. The resin coating system of claim 10, wherein said holding devices are fixed to said endless conveyor and hold said components spaced apart from and to a side of said endless conveyor so that when said components are treated in any of said stations, said holding devices and said endless conveyor remain untreated.

17. The resin coating system of claim 10, wherein each one of said holding devices further comprises coding means for identifying whether the component gripped by said one holding device is coated or uncoated.

18. The coating system of claim 17, further comprising sensor means for reading said coding means, said sensor means positioned at least at said coating station to prevent recoating of a coated component.

19. The resin coating system of claim 1, further comprising memory means associated with said endless conveyor for identifying whether a component carried on said endless conveyor is coated or uncoated.

20. The resin coating system of claim 19, further comprising a microprocessor linked to said memory means for recording the condition of each component at each position along said endless conveyor.

21. The resin coating system of claim 19, further comprising means linked to said memory means for counting increments of said endless conveyor to determine the position of a coated component which passes said transfer station and reapproaches said preheating station and said coating station.

22. The resin coating system of claim 1, wherein:

each said resin dispenser comprises a flexible dispenser tube from which resin is applied to said components; and said preventing means comprises means for displacing said dispenser tube so that resin flowing from said dispenser tube does not flow onto a coated component beneath said dispenser tube.

23. The resin coating system of claim 1, wherein:

each said resin dispenser comprises a mixer tube for mixing resin and catalyst and a pump for supplying resin and catalyst to said mixer tube; and said preventing means comprises means for stopping said pump from supplying resin and catalyst to said mixer tube.

24. The resin coating system of claim 1 wherein:

each said resin dispenser comprises a dispenser tube from which resin is applied to said components; and said preventing means comprises a resin diverting tray selectively positionable between said dispenser tube and said component beneath said dispenser tube to prevent recoating of a coated component.

25. The resin coating system of claim 1 wherein each said resin dispenser comprises a mixer tube for mixing resin and catalyst, a manifold coupled to and supplied by said mixer tube, and a plurality of dispenser tubes supplied by said manifold, each said dispenser tube applying resin to an uncoated component.

26. The resin coating system of claim 1 wherein:

each said component has a first end and a second end to be coated; and wherein said plurality of resin dispensers comprises a first resin dispenser positioned to apply resin to said first end of said component and a second resin dispenser positioned to apply resin to said second end of said component.

27. A resin coating system comprising:

a coating station for dispensing resin and applying the resin to uncoated components, said coating station comprising a plurality of resin dispensers;

a gelification station downstream of said coating station in which the resin on components coated in said coating station solidifies;

a transfer station at which components to be coated are loaded for transfer into said coating station and components which have been coated and have passed through said gelification station are unloaded after transfer out of said gelification station;

an endless conveyor for conveying components through said coating station, said gelification station and said transfer station;

means associated with said endless conveyor for identifying whether a component on said endless conveyor is coated or uncoated; and means, responsive to said means for identifying, for preventing coating of a coated component in said coating station by preventing dispensing of resin from an individual resin dispenser onto a coated component while uncoated components in said coating station continue to be coated with resin.

28. A resin coating station comprising:

a plurality of resin dispensers for applying resin to components;

means associated with said resin dispensers for identifying whether a component adjacent said resin dispensers is coated or uncoated; and means responsive to said means for identifying, and linked to said resin dispensers, for preventing coating of coated components adjacent said resin dispensers while uncoated components adjacent said resin dispensers continue to be coated.

29. The resin coating station of claim 28 wherein:

said resin dispensers each have a flexible dispenser tube for applying resin to said components; and said means for preventing the application of resin comprises means associated with each flexible dispenser tube for displacing said flexible dispenser tube so that resin flowing from said dispenser tube does not flow onto a coated component beneath said dispenser tube.

30. The resin coating station of claim 28 wherein:

each said resin dispenser has a mixer tube for mixing resin and catalyst and a pump for supplying resin and catalyst to said mixer tube; and said means for preventing the application of resin comprises means for stopping said pump from supplying resin and catalyst to said mixer tube.

31. The resin coating station of claim 28 wherein:

each said resin dispenser has a dispenser tube for applying resin to said components; and said means for preventing the application of resin comprises a resin diverting tray insertable between said dispenser tube and said coated component.

* * * * *